US009726337B2

(12) United States Patent
Hedberg, Jr.

(10) Patent No.: US 9,726,337 B2
(45) Date of Patent: Aug. 8, 2017

(54) LIGHT FIXTURE FOR INDIRECT ASYMMETRIC ILLUMINATION WITH LEDS

(71) Applicant: R. W. Swarens Associates, Inc., El Monte, CA (US)

(72) Inventor: M. Lee Hedberg, Jr., Tusti, CA (US)

(73) Assignee: R. W. SWARENS ASSOCIATES, INC., El Monte, CA (US)

( * ) Notice: Subject to any disclaimer, the term of this patent is extended or adjusted under 35 U.S.C. 154(b) by 99 days.

(21) Appl. No.: 14/470,876

(22) Filed: Aug. 27, 2014

(65) Prior Publication Data

US 2016/0061413 A1 Mar. 3, 2016

(51) Int. Cl.

| | |
|---|---|
| ***F21S 8/00*** | (2006.01) |
| ***F21S 8/02*** | (2006.01) |
| ***F21V 7/00*** | (2006.01) |
| ***F21V 7/06*** | (2006.01) |
| *F21Y 115/10* | (2016.01) |

(52) U.S. Cl.

CPC ..... *F21S 8/026* (2013.01); *F21V 7/0008* (2013.01); *F21V 7/06* (2013.01); *F21Y 2115/10* (2016.08)

(58) Field of Classification Search

CPC ..... F21V 7/0025; F21V 7/00; F21V 7/0008; F21V 7/005; F21V 21/047; F21S 8/026

See application file for complete search history.

(56) References Cited

U.S. PATENT DOCUMENTS

| | | | | |
|---|---|---|---|---|
| 4,748,543 A | | 5/1988 | Swarens | |
| 5,142,459 A | | 8/1992 | Swarens | |
| 5,199,782 A | * | 4/1993 | Johnson | F21S 8/026 362/135 |
| 6,474,852 B1 | * | 11/2002 | Ohkohdo | B60Q 1/2696 362/237 |
| 6,739,734 B1 | | 5/2004 | Hulgan | |
| 6,851,834 B2 | | 2/2005 | Leysath | |
| 7,217,009 B2 | | 5/2007 | Klose | |
| 7,556,399 B1 | | 7/2009 | Bailey | |
| 7,665,866 B2 | | 2/2010 | Mayer | |
| 7,959,332 B2 | | 6/2011 | Tickner | |
| 7,993,034 B2 | | 8/2011 | Wegner | |
| 8,002,446 B1 | | 8/2011 | Plunk | |
| 8,113,680 B2 | * | 2/2012 | O'Brien | F21S 8/026 362/147 |
| 8,132,944 B2 | | 3/2012 | Ruud | |
| 8,220,961 B2 | | 7/2012 | Belknap | |
| 8,317,367 B2 | | 11/2012 | Venhaus | |

(Continued)

*Primary Examiner* — Andrew Coughlin

*Assistant Examiner* — Meghan Ulanday

(74) *Attorney, Agent, or Firm* — IDP Patent Services; Olav M. Underdal

(57) ABSTRACT

A light fixture optimized for directional lighting, including LED lighting, includes a fixture housing, further including a lighting element shelf and a window opening; a reflector, which is configured with a special parabolic shape, a lighting element which is mounted on an inside surface of the lighting element shelf, such that light emitted from the lighting element will reflect at least one time on the reflector, before exiting the light fixture via the window opening as a wide and uniform field of asymmetric indirect illumination. The light fixture can be configured in versions suitable for wall illumination, conference room illumination, ceiling illumination, ground surface illumination, and related illumination applications for interior and exterior use.

16 Claims, 9 Drawing Sheets

LED light fixture for wall illumination

(56) References Cited

U.S. PATENT DOCUMENTS

| | | | |
|---|---|---|---|
| 8,328,390 | B2 | 12/2012 | Marson |
| 8,360,620 | B1 | 1/2013 | Rashidi |
| 8,534,865 | B2 | 9/2013 | Kim |
| 8,602,586 | B1 | 12/2013 | Dau |
| 2013/0294059 | A1 | 11/2013 | Galluccio |
| 2014/0009931 | A1 | 1/2014 | Tickner et al. |

* cited by examiner

LED light fixture for wall illumination

LED light fixture for video conference illumination

LED light fixture for cove illumination

LED light fixture for exterior ground surface illumination

FIG. 10

Light intensity distribution of LED light fixture for wall illumination 1002 100 1000

| | | | | | | | | | | | | | | | | | | |
|---|---|---|---|---|---|---|---|---|---|---|---|---|---|---|---|---|---|---|
| 1 | 1 | 2 | 3 | 7 | 15 | 30 | 59 | 99 | 117 | 99 | 59 | 30 | 15 | 7 | 3 | 2 | 1 | 1 |
| 1 | 2 | 3 | 6 | 10 | 17 | 30 | 49 | 70 | 80 | 70 | 49 | 30 | 17 | 10 | 6 | 3 | 2 | 1 |
| 2 | 3 | 5 | 8 | 14 | 22 | 36 | 53 | 71 | 78 | 71 | 53 | 36 | 22 | 14 | 8 | 5 | 3 | 2 |
| 3 | 4 | 6 | 10 | 15 | 22 | 33 | 45 | 56 | 60 | 56 | 45 | 33 | 22 | 15 | 10 | 6 | 4 | 3 |
| 3 | 5 | 7 | 10 | 14 | 20 | 27 | 34 | 41 | 43 | 41 | 34 | 27 | 20 | 14 | 10 | 7 | 5 | 3 |
| 3 | 5 | 6 | 9 | 12 | 16 | 21 | 26 | 29 | 30 | 29 | 26 | 21 | 16 | 12 | 9 | 6 | 5 | 3 |
| 3 | 4 | 6 | 8 | 10 | 13 | 16 | 19 | 21 | 22 | 21 | 19 | 16 | 13 | 10 | 8 | 6 | 4 | 3 |

1004

20' x 8'ht wall – lighting fixture 3' from the wall

Light intensity distribution of LED Light fixture for video conferencing

Light levels on conferee's face – Lighting fixture 4' from the face, in 8′ ceiling Light intensity distribution of LED light fixture for cove illumination

| | | | | | | | | | | | | | |
|---|---|---|---|---|---|---|---|---|---|---|---|---|---|
| 2 | 3 | 3 | 3 | 3 | 3 | 2 | 2 | 1 | 1 | 1 | 0 | 0 | 0 |
| 4 | 5 | 6 | 5 | 5 | 4 | 3 | 2 | 2 | 1 | 1 | 1 | 0 | 0 |
| 7 | 9 | 10 | 9 | 7 | 6 | 4 | 3 | 2 | 1 | 1 | 1 | 0 | 0 |
| 13 | 17 | 17 | 15 | 11 | 8 | 6 | 4 | 2 | 2 | 1 | 1 | 1 | 0 |
| 26 | 33 | 32 | 25 | 17 | 11 | 7 | 5 | 3 | 2 | 1 | 1 | 1 | 0 |
| 53 | 65 | 56 | 39 | 25 | 15 | 9 | 6 | 3 | 2 | 1 | 1 | 1 | 0 |
| 92 | 110 | 86 | 54 | 31 | 18 | 10 | 6 | 4 | 2 | 1 | 1 | 1 | 0 |
| 113 | 134 | 101 | 61 | 34 | 19 | 11 | 6 | 4 | 2 | 2 | 1 | 1 | 0 |
| 92 | 110 | 86 | 54 | 31 | 18 | 10 | 6 | 4 | 2 | 1 | 1 | 1 | 0 |
| 53 | 65 | 56 | 39 | 25 | 15 | 9 | 6 | 3 | 2 | 1 | 1 | 1 | 0 |
| 26 | 33 | 32 | 25 | 17 | 11 | 7 | 5 | 3 | 2 | 1 | 1 | 1 | 0 |
| 13 | 17 | 17 | 15 | 11 | 8 | 6 | 4 | 2 | 2 | 1 | 1 | 1 | 0 |
| 7 | 9 | 10 | 9 | 7 | 6 | 4 | 3 | 2 | 1 | 1 | 1 | 0 | 0 |
| 4 | 5 | 6 | 5 | 5 | 4 | 3 | 2 | 2 | 1 | 1 | 1 | 0 | 0 |
| 2 | 3 | 3 | 3 | 3 | 3 | 2 | 2 | 1 | 1 | 1 | 0 | 0 | 0 |

Light levels on ceiling with light fixture in cove 3′ below ceiling

Light intensity distribution of LED light fixture for exterior ground surface illumination Light levels on ground surface with light fixture 2’ above ground

LIGHT FIXTURE FOR INDIRECT ASYMMETRIC ILLUMINATION WITH LEDS

CROSS-REFERENCE TO RELATED APPLICATIONS

N/A

FIELD OF THE INVENTION

The present invention relates generally to the field of light fixtures, and more particularly to improvements related to use of light emitting diodes in compact indirect light fixtures of the offset hidden source type for illuminating selected flat surfaces in commercial and residential buildings.

BACKGROUND OF THE INVENTION

Use of light emitting diodes, also known as LEDs, in light fixtures have become increasingly popular. LED lighting is more energy efficient and has a longer expected mean time before failure than both incandescent and fluorescent lamp systems. Additionally, LED lighting does not have the warm-up time characteristic of fluorescent lighting.

On initial introduction to the market, prices of LED lamps and LED modules/assemblies were generally too high for most consumer and commercial use. In recent years, prices have been falling and consequently, due to the aforementioned advantages, LED lighting is gaining widespread acceptance in both the consumer and commercial markets.

LEDs typically do not emit light in all directions, and require a plurality of LED elements to achieve sufficient luminosity. Therefore, light fixtures will in many cases have to be redesigned in order to perform optimally. Typically, such redesigns may incorporate the use of special lenses that compensate for the more directional light emitted from LEDs. Such light fixture redesigns may be more bulky and more costly to manufacture than traditional fixtures for fluorescent or incandescent light sources.

U.S. Pat. No. 4,748,543, for a HIDDEN SOURCE FLUORESCENT LIGHT WASH FIXTURE issued May 31, 1988, contains background information relevant to the present invention. The abovementioned patent and the various embodiments of the present invention, address offset hidden source type light fixtures designed especially for the purpose of providing architecturally distinctive indirect lighting treatments wherein a fixture (or row of side-by-side fixtures), flush mounted into a flat surface such as wall or ceiling of a room, "washes" a nearby flat surface such as a wall, floor or ceiling, perpendicular to the mounting surface, with uniform illumination.

In the abovementioned patent, a thin flexible offset reflective lining is adhesively attached to a rigid aluminum reflector mounting body extruded in a special compound curved shape having an offset lamp-surround portion blending into an extended "throw" portion so as to provide uniform "wash" illumination from the fluorescent lamp concealed within the lamp-surround portion.

U.S. Pat. No. 5,142,459, for a HIDDEN SOURCE FLUORESCENT LIGHT WASH FIXTURE issued Aug. 25, 1992, discloses further development of this type of light fixture with an alternative reflector configuration and associated mounting system for an improved "wash" light fixture of the offset hidden source type, based on refinements of the optical principles of U.S. Pat. No. 4,748,543, but providing new benefits with regard to illumination coverage, manufacturability, and reflector replaceability.

This product improvement allows configuration of a light fixture of the fluorescent offset-reflector hidden-light-source wall-wash type, such that it provides substantially uniform illumination along with improved shielding of direct light from the source and suppression of spurious highlights reflected from fixture surfaces.

Additionally, it provides a reflector mounting configuration in which a specially shaped curved reflector is secured to the fixture in a manner that enables the reflector to be easily installed, removed and replaced, and which also provides the unique curved reflector surface shape required in this type of fixture, uniformly and reliably.

However, despite the improvements obtained in the aforementioned patents, these types of light fixtures are designed for light sources that emit light in all directions, and are therefore not well suited for LED lights in general, and modern commercial LED assemblies in particular, which generally emit light from a side of a plane surface, only in the direction away from the side of the plane surface.

Additionally, while light fixtures according to embodiments disclosed in U.S. Pat. No. 5,142,459 provide significantly improved shielding from direct light, these types of light fixtures still allow unshielded view of the lighting elements from some viewing positions.

As such, considering the foregoing, it may be appreciated that there continues to be a need for novel and improved devices and methods for LED based light fixtures.

SUMMARY OF THE INVENTION

The foregoing needs are met, to a great extent, by the present invention, wherein in aspects of this invention, enhancements are provided to the existing models for illumination with LED light fixtures.

Various aspects of the present invention provide a light fixture that is optimized for directional LED lighting, achieving a wide and uniform field of asymmetric illumination with virtual elimination of any direct light.

In an aspect, a light fixture, can include:

a. A fixture housing, which is closed in a rear side, and comprises a window opening in a front side, bordered along one side by a side panel, to which is connected a lighting element shelf;

b. A reflector, in the form of a one piece snap-in that requires no tools for installation, which is configured with a special parabolic shape, such that the reflector extends from a starting edge, and projects initially substantially asymptotically perpendicular in the cross-sectional plane to the window opening, thereafter extending towards the rear side of the light fixture, reaching an apex, from which the reflector continues an elongated parabolic curve, from the apex to an ending point; and c. At least one lighting element, which is mounted on an inside surface of the lighting element shelf, inside the fixture housing, such that the lighting element provides directional light, towards the rear side of the fixture housing;

Such that substantially all light emitted from the lighting element, will reflect at least one time on the reflector, before exiting the light fixture via the window opening.

In various related aspects, the light fixture can be configured in version suitable for wall illumination, conference room illumination, ceiling illumination, ground surface illumination, and related illumination applications for interior and exterior illumination.

In a related aspect, the lighting element shelf can further include an angled ledge, which protrudes inward at an angle, in order to eliminate direct visibility of the lighting element.

In a related aspect, the lighting element can be a LED lighting assembly.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 10 illustrates a light intensity distribution for a LED light fixture for wall illumination, according to an embodiment of the invention.

DETAILED DESCRIPTION

Figure 1:
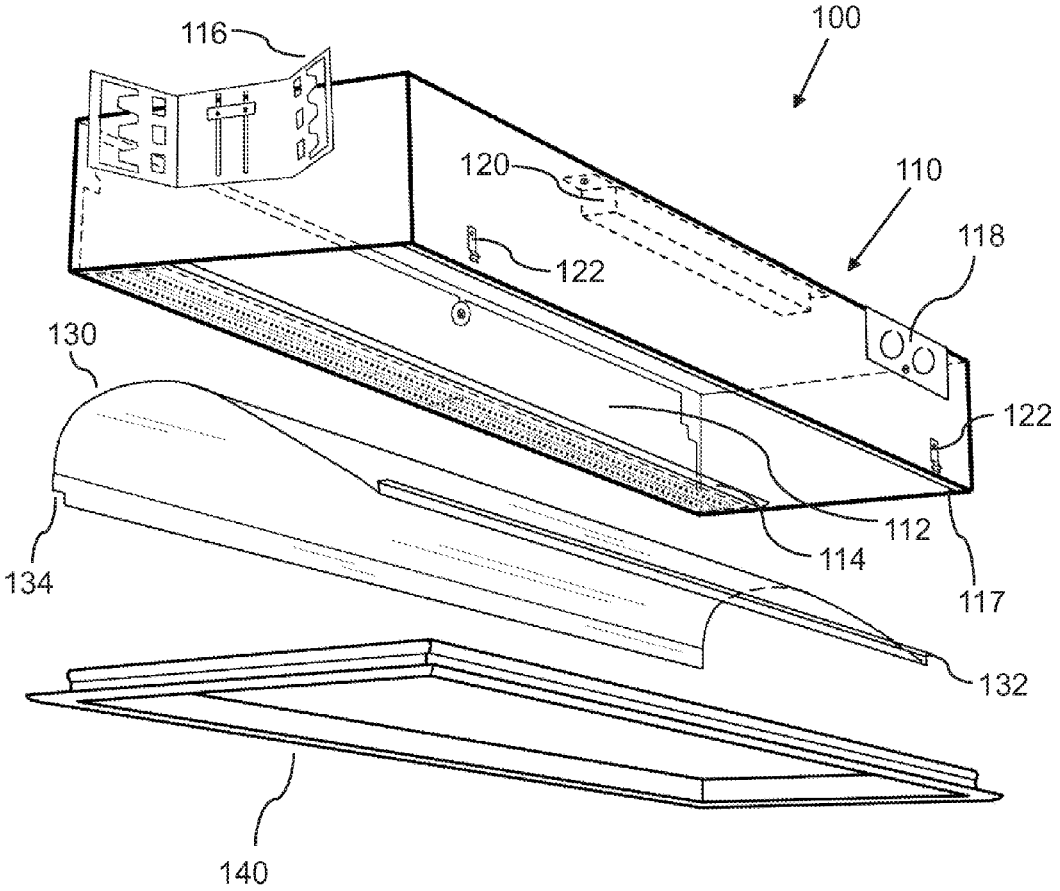
FIG. 1 is a perspective partially exploded view of a LED light fixture for indirect asymmetric illumination, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a light fixture for indirect asymmetric illumination 100 with reference to FIG. 1, in such manner that like reference numerals refer to like components throughout; a convention that we shall employ for the remainder of this specification.

In an embodiment, FIG. 1 shows a partially exploded perspective view of a light fixture 100. The light fixture 100 is shown in a downward facing orientation, such as for installation in a ceiling. The fixture housing 110 is closed on top and provides a large light window opening at the bottom bordered along one side by a side panel 112 connected along its edge with a lighting element shelf 114, which is in plane with the window opening 211 (illustrated in FIG. 2), shown in dotted line. One or more lighting elements (not visible in FIG. 1) can be mounted on the top surface of the lighting element shelf 114, inside the fixture housing 110.

The fixture housing 110 can be attached to the framing of a building by a mounting bracket 116. Once installed, the housing's leading bottom edge 117 can be set flush with the lower surface of the ceiling, or another surface of a building or structure. An electrical connection plate 118 further including a pair of knockout holes is located on the outside of fixture housing 110. Mounted inside the fixture housing 110 can be a ballast/driver 120, shown in dashed lines, for driving one or more lighting elements.

The reflector 130, shown removed from the fixture housing 110, can be made from a sheet of an appropriate material, which can be a plastic or a fiber composite, or a metal such as high purity aluminum formed into a special parabolic curved cross-sectional shape as shown. The reflector's ending edge can be formed with two bends to provide a Z-shaped cross section with an offset mounting flange 132 extending outwardly as shown, and the reflector ending edge can be straight, and can include at least one clearance notch 134, as shown. The reflector 130 can include other notches or cutouts, as required to provide clearance during installation or removal of the reflector 130. The formed reflector 130 can be manufactured in one piece and be spring loaded. It can snap into the fixture housing 110 without the need of tools.

A trim frame 140, for hard surface installations, can include flanges extending outward on all four sides from a four-sided collar portion. The collar portion can be dimensioned to fit around the outside of housing 110, and be held in place by fastening clips 122 attached onto the housing, such that the collar portion is configured with a shape such that it can snap on in place by the fastening clips 122. Other variations can be configured for installation in T-bar ceilings and surface/pendant installations.

Figure 2:
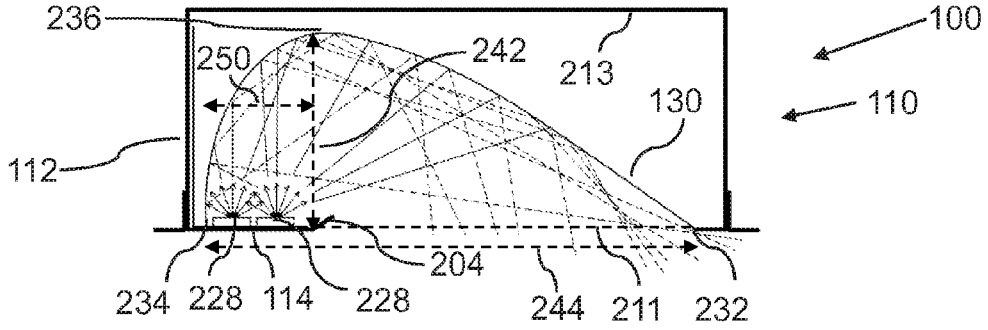
FIG. 2 is a cross-sectional side view of a LED light fixture for indirect asymmetric illumination, according to an embodiment of the invention.

In a related embodiment, FIG. 2 shows a cross sectional view of a light fixture 100, wherein the reflector 130 can be configured with a short parabolic shape, such that the reflector 130 extends from the starting edge 234, such that the reflector 130 is initially substantially asymptotically perpendicular in the cross-sectional plane to a window opening 211, such that an initial angle between the reflector 130 and the window opening 211 is in a range of −5 to +5 degrees from a 90 degree perpendicular angle, thereafter extending in a parabolic curve towards the rear panel 213 of the light fixture, reaching an apex 236, after 20-30% 250 of the horizontal projection length or reflector width 244 in the plane of the window opening, from the starting edge 234 of the cross-sectional reflector 130 curve to the ending edge 232, from where the curve continues an elongated parabolic curve, from the apex 236 to the ending point 232. As shown on FIG. 2, a short parabolic shape of the reflector 130 can be configured with a reflector depth 242 to width 244 ratio of the reflector 130 of equal to or less than 1:3, wherein the reflector depth 242 is the length of the shortest straight line in the cross-sectional plane from the apex 236 to the straight line between the starting and ending points 234 232, and the reflector width is the length of the straight line between the starting and ending points 234 232. A short parabolic shape of the reflector 130 can have depth to width ratio of equal to or less than 1:3, such as for example, as shown in FIG. 2, approximately 1:2.5, 1:2, or even 1:1 or less.

As shown on FIG. 2, lighting elements 228 can be positioned on the top surface of the lighting element shelf 114, inside the fixture housing 110, in the plane of the window opening, from the starting edge 234 of the cross-sectional reflector 130 curve to the ending edge 232, whereby the lighting elements 228 are effectively shielded from direct visibility, such that all light is transmitted indirectly via the reflector 130, as shown by light paths in dotted lines.

In a related embodiment, the light fixture 100 can further include an angled ledge 204, which is connected to an inner edge of the lighting element shelf 114, and protrudes inwards at an angle, which can be fixed at an angle in a range of 0 to 90 degrees. In FIG. 2, the angled ledge 204 is shown protruding at approximately 45 degrees. The angled ledge 204 can serve to improve shielding of direct light from the edge of the lighting elements 228.

In a related embodiment, the angled ledge 204 can be reflective on the inner side, such that light from the lighting elements 228 is reflected back on to the reflector 130, and is eventually emitted from the light fixture 100 as indirect light.

In a related embodiment, the angled ledge 204 can be adjustable such that the angle can be adjusted between 0 and 90 degrees.

Figure 3:
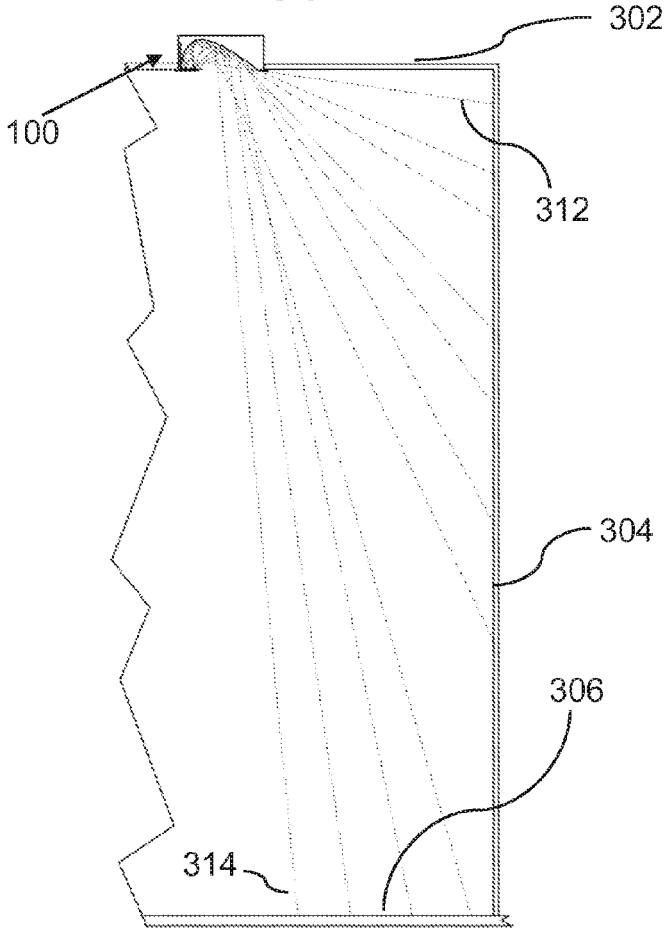
FIG. 3 is a cross-sectional side view illustrating illumination of a wall by a LED light fixture, according to the embodiment of the invention shown in FIG. 2.

FIG. 3 illustrates the embodiment of FIG. 2 mounted into a ceiling 302 and directed to an adjacent wall 304 and a floor 306, such that light emitted from the lighting elements 228 is "washed" on to the wall 304 and the floor 306.

All light paths, as shown on FIG. 3, represent indirect, reflected light. The design provides optimum uniformity of lighting on the surface being illuminated. The light paths 312 and 314 represent the boundaries of reflected light. The light fixture can be configured in a plurality of sizes and reflector shapes for positioning at varying distances from the wall 304, thereby providing uniform lighting on the wall 304.

FIG. 10 illustrates the light intensity distribution from the light fixture 100 installed in a ceiling. Numeric values in FIG. 10 indicate light intensity readings in foot-candles, in a position on a wall 1000, specified by the center point of a numeric value, as distributed over a 20' width 1002 by 8 foot height 1004 wall 1000; with the light fixture 100 installed 3' from the wall.

Figure 4:
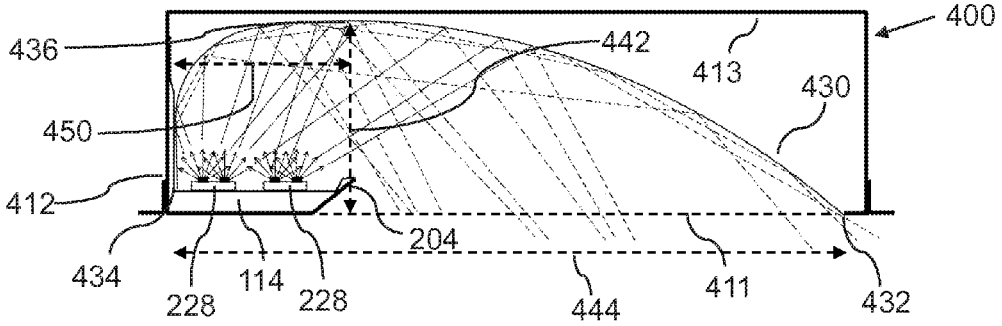
FIG. 4 is a cross-sectional side view of a LED light fixture for indirect asymmetric illumination, according to an embodiment of the invention.

In a related embodiment, FIG. 4 shows a cross sectional view of a light fixture 400 for illumination of a conference room, wherein the reflector 430 is shown configured with an elongated parabolic shape, such that the reflector 430 extends from the starting edge 434, such that the reflector 430 is initially substantially asymptotically perpendicular in the cross-sectional plane to a window opening 411, such that an initial angle between the reflector 430 and the window opening 411 is in a range of −5 to +5 degrees from a 90 degree perpendicular angle, thereafter extending in a parabolic curve towards the rear panel 413 of the light fixture 400, reaching an apex 436, after approximately 20-30% 450 of the horizontal projection length or reflector width 444 in the plane of the window opening, from the starting edge 434 of the cross-sectional reflector 430 curve to the ending edge 432. As shown on FIG. 4, an elongated parabolic shape of the reflector 430 can be configured with a reflector depth 442 to width 444 ratio of the reflector 430 of more than 1:3, wherein the reflector depth 442 is the length of the shortest straight line in the cross-sectional plane from the apex 436 to the straight line between the starting and ending points 434 432, and the reflector width is the length of the straight line between the starting and ending points 434 234. An elongated parabolic shape of the reflector 430 can have depth to width ratio of more than 1:3, such as for example, as shown in FIG. 4, approximately 1:3.7, 1:4, or even 1:6 or more.

As shown the upper surface of the lighting element shelf 114 can be elevated such that the lighting elements 228 are higher than the plane of the window opening.

Figure 5:
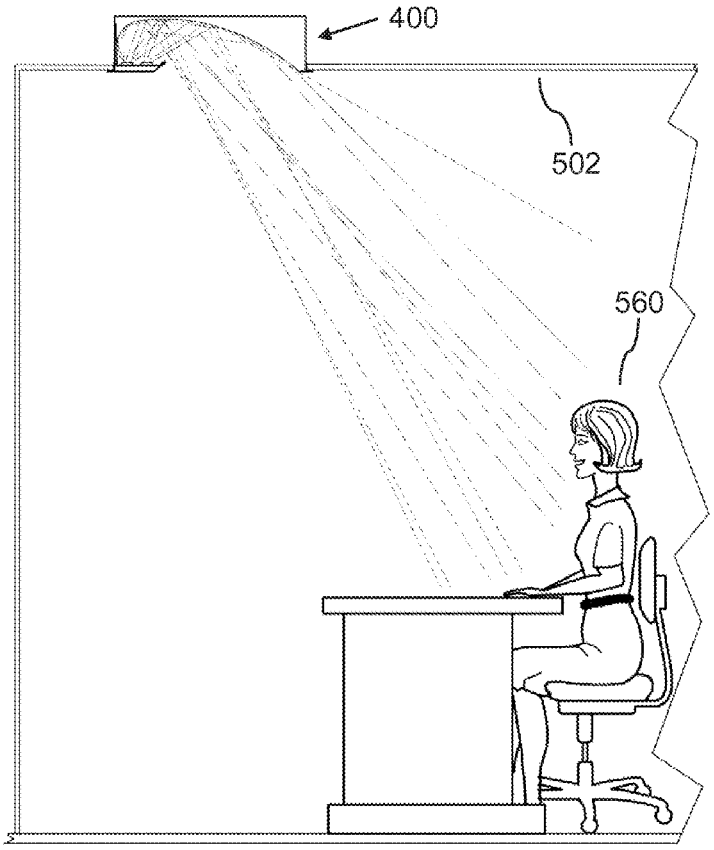
FIG. 5 is a cross-sectional side view illustrating illumination of a person by a LED light fixture, according to the embodiment of the invention shown in FIG. 4.

FIG. 5 illustrates the embodiment of FIG. 4 mounted into a ceiling 502, such that the light fixture 400 illuminates a person 560 in a room.

In a related embodiment, a plurality of light fixtures 400 can be installed in the ceiling of a video conference meeting room, such that the light fixtures 400, provides uniform illumination of the participants in a video conference.

Figure 11:
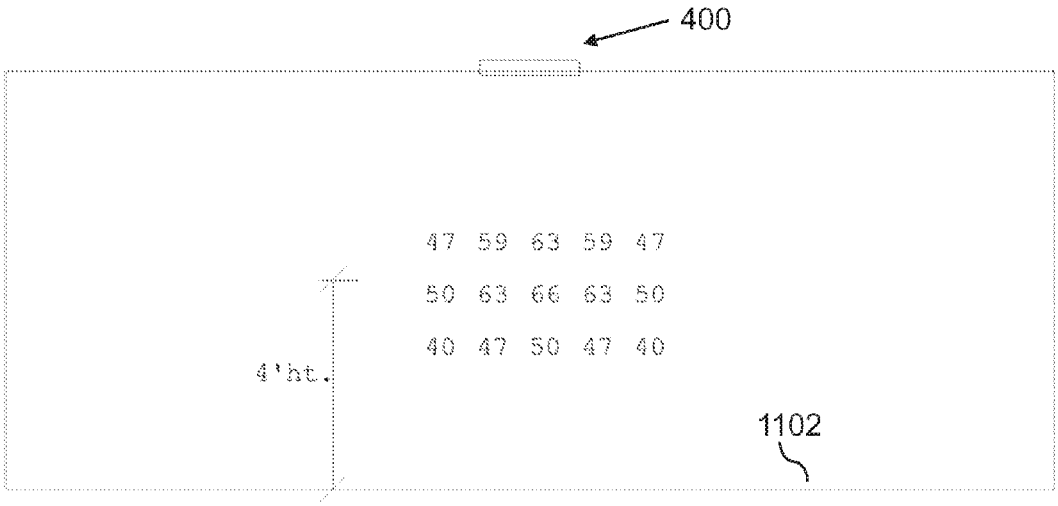
FIG. 11 illustrates a light intensity distribution for a LED light fixture for video conferencing, according to an embodiment of the invention.

FIG. 11 illustrates the light intensity distribution on the face of a video conference participant, as emitted from the light fixture 400 installed in a ceiling. Numeric values in FIG. 11 Indicate light intensity readings in foot-candles, as distributed over the face of the video conference participant, with the light fixture 400 installed 4' in front of the face and pointed in the direction of the participant's face, positioned at a location optimum to the height of the ceiling, such that the primary light distribution is at eye level 4' above the floor level 1102.

Figure 6:
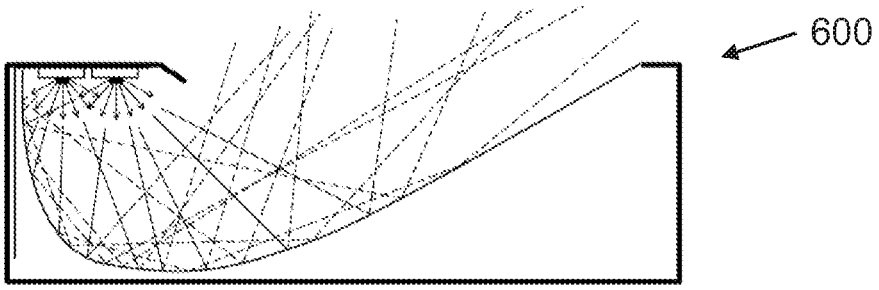
FIG. 6 is a cross-sectional side view of a LED light fixture for indirect asymmetric illumination, according to an embodiment of the invention.

FIG. 6 illustrates a light fixture 600 for cove illumination, as an inverted configuration of the embodiment of FIG. 1.

Figure 7:
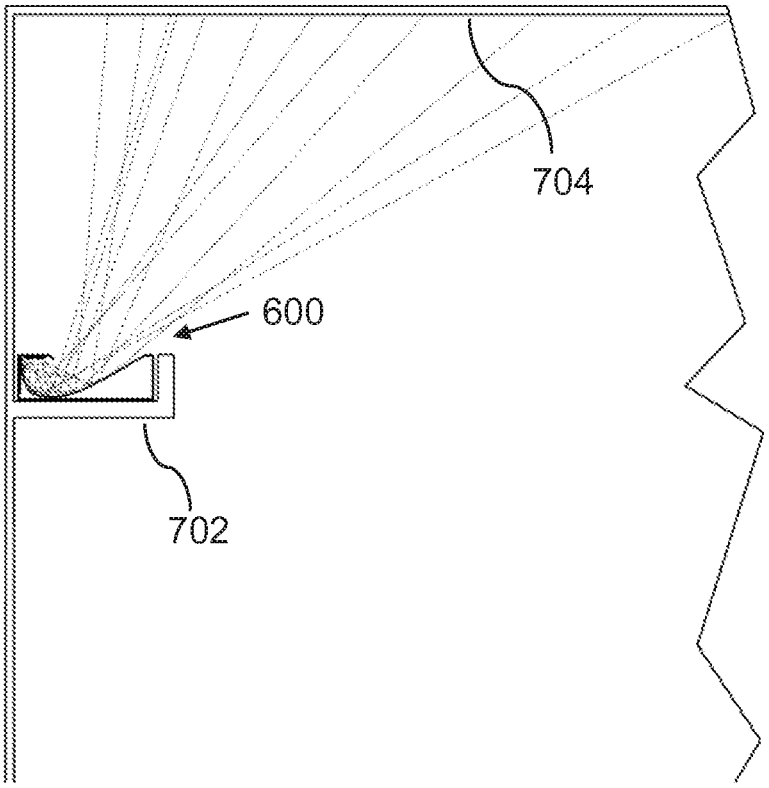
FIG. 7 is a cross-sectional side view illustrating illumination of a ceiling by a cove mounted LED light fixture, according to the embodiment of the invention shown in FIG. 6.

FIG. 7 illustrates the embodiment of FIG. 6 mounted in a cove 702, such that the light fixture 600 can illuminate a ceiling 704.

In a related embodiment, a plurality of light fixtures 600 can be installed in the cove in a room, such that the light fixtures 600, provides uniform illumination of the ceiling.

Figure 12:
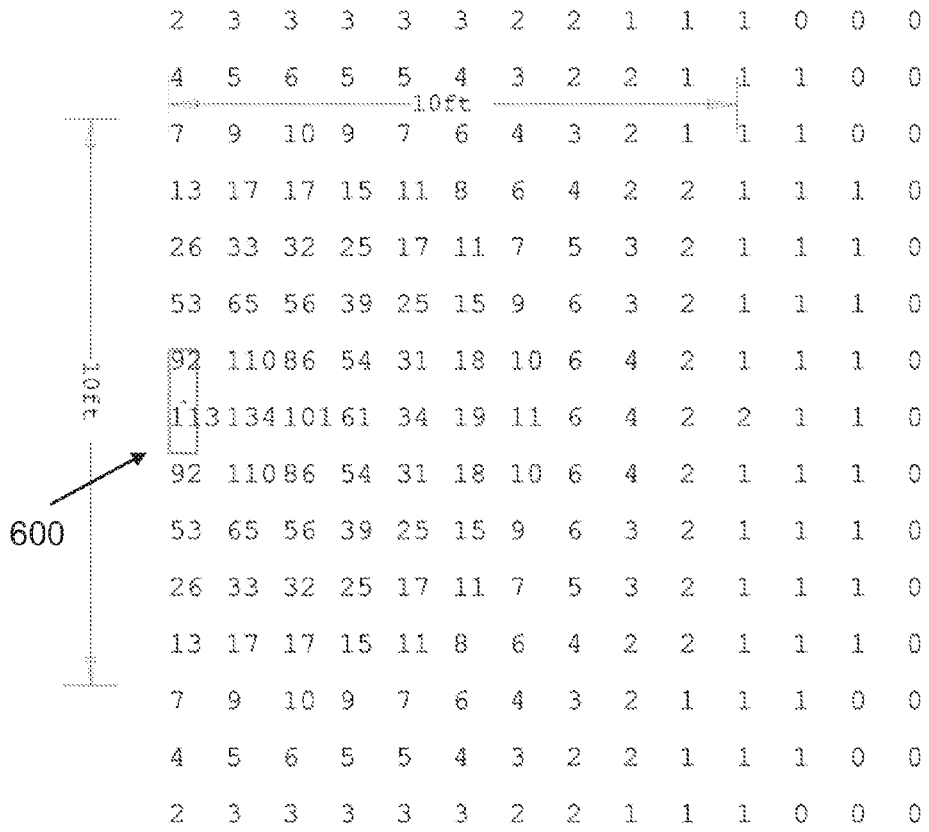
FIG. 12 illustrates a light intensity distribution for a LED light fixture for cove illumination, according to an embodiment of the invention.

FIG. 12 illustrates the light intensity distribution on a ceiling, as emitted from the light fixture 600 for cove illumination. Numeric values in FIG. 12 indicate light intensity readings in foot-candles, as distributed over the ceiling in units of one foot, with the light fixture 600 installed in a cove 3' below ceiling and pointed in the direction of the ceiling.

Figure 8:
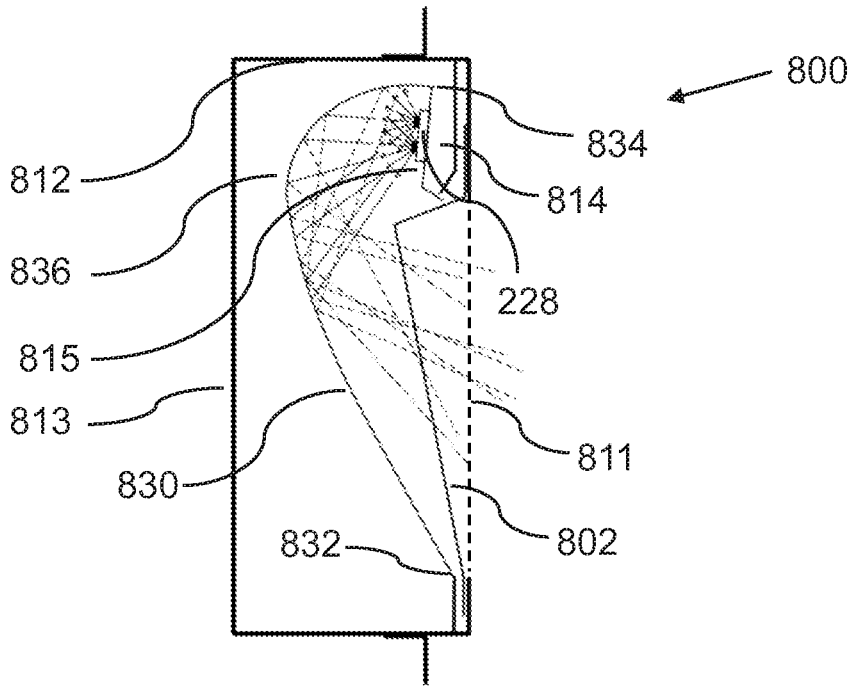
FIG. 8 is a cross-sectional side view of a LED light fixture for indirect asymmetric illumination, according to an embodiment of the invention.

In a related embodiment, FIG. 8 shows a cross sectional view of a light fixture 800 for exterior ground surface illumination, wherein the reflector 830 is shown configured with a short parabolic shape, such that the reflector 830 extends from the starting edge 834, such that the reflector 830 is initially substantially asymptotically perpendicular in the cross-sectional plane to a window opening 811, such that an initial angle between the reflector 830 and the window opening 811 is in a range of −5 to +5 degrees from a 90 degree perpendicular angle, thereafter extending in a parabolic curve towards the rear panel 813 of the light fixture 800, reaching an apex 836, after 20-30% of the vertical projection length in the plane of the window opening 811, from the starting edge 834 of the cross-sectional reflector 830 curve to the ending edge 832, from where the curve continues an elongated parabolic curve, from the apex 836 to the ending point 832. The window opening of the light fixture can be covered by a regressed lens 802, thereby providing a more vandal resistant product, while eliminating lamp imaging.

Figure 9:
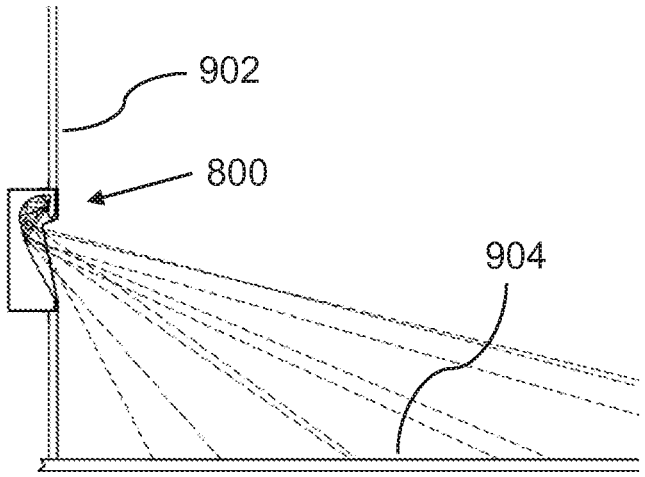
FIG. 9 is a cross-sectional side view illustrating illumination of an exterior floor surface by a LED light fixture, according to the embodiment of the invention shown in FIG. 8.

FIG. 9 illustrates a light fixture 800, as shown in FIG. 8, mounted in a wall 902, such that the light fixture 800 can illuminate a ground surface 904.

In a related embodiment, as shown in FIG. 8, an inner surface 815 of the lighting element shelf 814 can be recessed, such that the inner surface is further inside the fixture housing, as compared to the window opening plane 811, shown in dotted line from a cross-sectional view. In addition, the inner surface can be angled in the cross-sectional plane, such that the cross-sectional inner surface is not parallel with the cross-sectional window plane. In FIG. 8, the inner surface is shown with a slightly negative angle, approximately −5 degrees, directing light such that it is tilted towards the side of the lighting fixture. In various embodiments, the angle can configured in a range of −20 to +20 degrees. In various embodiments, the recess of the inner surface can be in a range of 0.5-10 cm. Depending on the size of the light fixture 800, the recess in some cases can be larger than 10 cm.

In a further related embodiment, the angle of the lighting element shelf 814 and/or the inner surface of the lighting element shelf 814 can be adjustable, for example via a pivotal axle.

Figure 13:
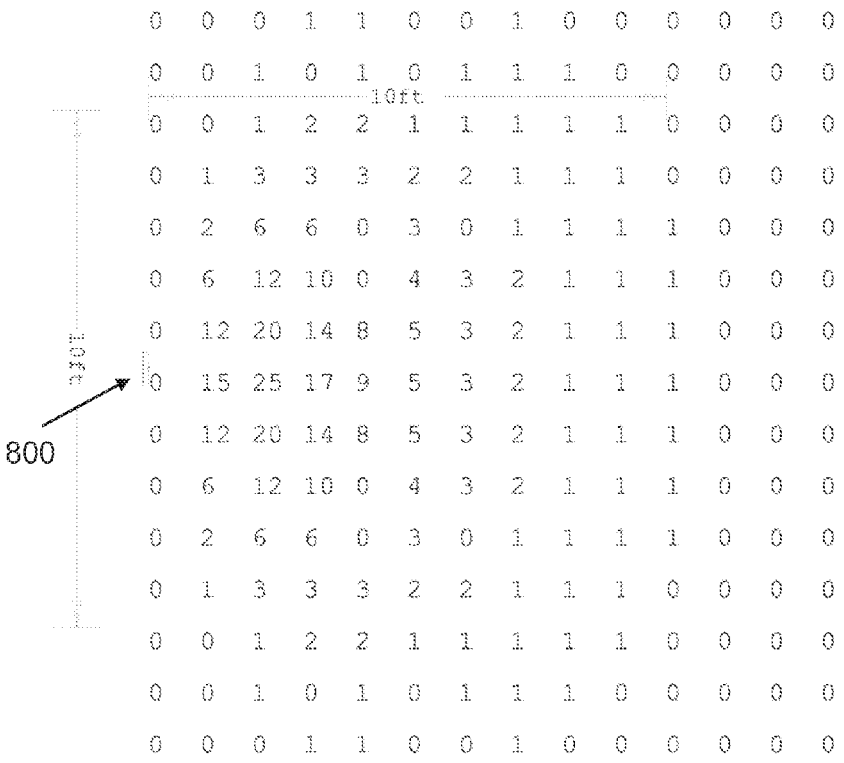
FIG. 13 illustrates a light intensity distribution for a LED light fixture for exterior ground surface illumination, according to an embodiment of the invention.

FIG. 13 illustrates the light intensity distribution on a ground surface, as emitted from the light fixture 800 for exterior ground surface illumination. Numeric values in FIG. 13 indicate light intensity readings in foot-candles, as distributed over the ground surface in units of one foot, with the light fixture 800 installed in a wall by the ground surface, such that the lower part of the light fixture 800 is 2' above the ground surface.

In a related embodiment, two reflective end plates can be provided, one at each end of the fixture housing 110, attached to the inside of the housing end walls with double-sided adhesive foam material so as to urge the end plates against the two ends of the reflector.

In the various related embodiments, the lighting element 228 can be an LED lighting assembly or a group of LED lighting assemblies. For example, the lighting element can be a distributed array module of the brand PrevaLED™, manufactured by Osram™, such as for example modules of the type 73574PLPG2-BAR-1100-830-280X38-DC.

In various alternative embodiments, other directional lighting element types, styles, and ratings can be used for the lighting element 228.

In various related embodiments, the basic reflector shape can be scaled in size, and fixtures can be supplied in various common nominal lengths such as 18", 2', 3', 4', etc.

In various related embodiments, the reflector can be configured with a plurality of alternative mating tongue-and-groove type attachment approaches; for example, male members at the two reflector ends could be made to engage female members on the two opposite housing window edges, or female members at the two reflector ends could be made to engage male members on the two opposite housing window edges.

In related embodiments, the fixture housing can be formed entirely from sheet metal such as steel or the major portion surrounding the reflector and defining its mountings can be extruded from aluminum. Alternatively, the fixture housing can be made of plastic or plastic and/or fiber composites.

In related embodiments, the ballast/driver 120, transformer, and associated wiring can be enclosed by a sheet metal baffle plate in compliance with electrical safety requirements.

In related embodiments, LED drivers used to power LED assemblies should provide pure DC (direct current) output to the LED assemblies, such that there is no issue of flicker. Flicker can be caused by the design of the driver's power output having any derivative of 60-hertz cycle AC (alternating current) power delivered to the LED assemblies.

In related embodiments, the reflective surface of the reflector can be highly polished or finely diffused, and can be color-tinted for special effect.

The many features and advantages of the invention are apparent from the detailed specification, and thus, it is intended by the appended claims to cover all such features and advantages of the invention, which fall within the true spirit and scope of the invention.

The present embodiments are therefore to be considered in all respects as illustrative and not restrictive, and all variations, substitutions and changes, which come within the meaning and range of equivalency of the claims are therefore intended to be embraced therein.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A light fixture, comprising:

a) a fixture housing, which is closed in a rear side, and comprises a window opening in a front side, bordered along one side by a side panel, to which is connected a lighting element shelf;

b) a reflector, configured with a parabolic shape such that the reflector extends from a starting edge, such that the reflector is initially substantially asymptotically perpendicular in a cross-sectional plane to the window opening, such that an initial angle between the reflector and the window opening is in a range of −5 to +5 degrees from a 90 degree perpendicular angle, the reflector thereafter extending in a parabolic curve towards the rear side of the light fixture, reaching an apex, from which the curve continues a parabolic curve, from the apex to an ending point, wherein only the starting edge of the reflector is substantially asymptotically perpendicular in the cross-sectional plane to the window opening c) at least one lighting element, mounted on the inside surface of the lighting element shelf, inside the fixture housing, wherein the lighting element provides directional light, in direction from a plane of an inner surface of the lighting element towards the rear side; and d) an angled ledge, which is connected to an inner edge of the lighting element shelf, and protrudes inwards at an angle, in a range of 0 to 90 degrees, whereby the angled ledge shields direct light from the lighting element;

wherein the angled ledge is reflective on an inner side, such that light from the lighting element directed on to the angled ledge, is reflected on to the reflector, and is eventually emitted via the window opening as indirect light;

such that light emitted from the lighting element, will reflect at least one time on the reflector, before exiting the light fixture via the window opening.

2. The light fixture of claim 1, wherein the reflector is further configured with a short parabolic shape, such that the apex is configured in a position on the parabolic curve at 20-30% of a horizontal projection length in a plane of the window opening, from the starting edge of the cross-sectional reflector curve to the ending edge, with a reflector depth to reflector width ratio of at most 1:3.

3. The light fixture of claim 1, wherein the reflector is further configured with an elongated parabolic shape, such that the apex is configured in a position approximately at 20-30% of a horizontal projection length in a plane of the window opening, from the starting edge of the cross-sectional reflector curve to the ending edge, with a reflector depth to reflector width ratio of more than 1:3.

4. The light fixture of claim 1, wherein the angled ledge is adjustable.

5. The light fixture of claim 1, wherein the lighting element is a light emitting diode lighting assembly.

6. The light fixture of claim 1, further configured with two reflective end plates attached to the inside of each side of the fixture housing, and connected to each end of the reflector.

7. The light fixture of claim 1, wherein the light fixture is further configured with a regressed lens that covers the window opening.

8. The light fixture of claim 1, wherein the lighting element shelf is in plane with the window opening, and parallel to the window opening.

9. The light fixture of claim 1, wherein an inner surface of the lighting element shelf is recessed, such that the inner surface is further inside the fixture housing, as compared to the window opening plane.

10. The light fixture of claim 1, wherein an inner surface of the lighting element shelf is angled in a cross-sectional plane, such that the cross-sectional inner surface is not parallel with the cross-sectional window opening.

11. The light fixture of claim 10, wherein an angle of the inner surface is in a range of −20 to 20 degrees.

12. The light fixture of claim 10, wherein an angle of the lighting element shelf is adjustable.

13. The light fixture of claim 1, wherein an inner surface of the lighting element shelf is parallel with a plane of the window opening.

14. A light fixture, comprising:

a) a fixture housing, which is closed in a rear side, and comprises a window opening in a front side, bordered along one side by a side panel, to which is connected a lighting element shelf;

b) a reflector, configured with a parabolic shape such that the reflector extends from a starting edge, such that the reflector is initially substantially asymptotically perpendicular in a cross-sectional plane to the window opening, such that an initial angle between the reflector and the window opening is in a range of −5 to +5 degrees from a 90 degree perpendicular angle, the reflector thereafter extending in a parabolic curve towards the rear side of the light fixture, reaching an apex, from which the curve continues a parabolic curve, from the apex to an ending point, wherein only the starting edge of the reflector is substantially asymptotically perpendicular in the cross-sectional plane to the window opening c) at least one lighting element, mounted on the inside surface of the lighting element shelf, inside the fixture housing, wherein the lighting element provides directional light, in direction from a plane of an inner surface of the lighting element towards the rear side; and d) an angled ledge, which is connected to an inner edge of the lighting element shelf, and protrudes inwards at an angle, in a range of 0 to 90 degrees, whereby the angled ledge shields direct light from the lighting element;

wherein the angled ledge is adjustable;

such that light emitted from the lighting element, will reflect at least one time on the reflector, before exiting the light fixture via the window opening.

15. A light fixture, comprising:

a) a fixture housing, which is closed in a rear side, and comprises a window opening in a front side, bordered along one side by a side panel, to which is connected a lighting element shelf;

b) a reflector, configured with a parabolic shape such that the reflector extends from a starting edge, such that the reflector is initially substantially asymptotically perpendicular in a cross-sectional plane to the window opening, such that an initial angle between the reflector and the window opening is in a range of −5 to +5 degrees from a 90 degree perpendicular angle, the reflector thereafter extending in a parabolic curve towards the rear side of the light fixture, reaching an apex, from which the curve continues a parabolic curve, from the apex to an ending point, wherein only the starting edge of the reflector is substantially asymptotically perpendicular in the cross-sectional plane to the window opening c) at least one lighting element, mounted on the inside surface of the lighting element shelf, inside the fixture housing, wherein the lighting element provides directional light, in direction from a plane of an inner surface of the lighting element towards the rear side; and d) two reflective end plates attached to the inside of each side of the fixture housing, and connected to each end of the reflector;

such that light emitted from the lighting element, will reflect at least one time on the reflector, before exiting the light fixture via the window opening.

16. A light fixture, comprising:

a) a fixture housing, which is closed in a rear side, and comprises a window opening in a front side, bordered along one side by a side panel, to which is connected a lighting element shelf;

b) a reflector, configured with a parabolic shape such that the reflector extends from a starting edge, such that the reflector is initially substantially asymptotically perpendicular in a cross-sectional plane to the window opening, such that an initial angle between the reflector and the window opening is in a range of −5 to +5 degrees from a 90 degree perpendicular angle, the reflector thereafter extending in a parabolic curve towards the rear side of the light fixture, reaching an apex, from which the curve continues a parabolic curve, from the apex to an ending point, wherein only the starting edge of the reflector is substantially asymptotically perpendicular in the cross-sectional plane to the window opening and c) at least one lighting element, mounted on the inside surface of the lighting element shelf, inside the fixture housing, wherein the lighting element provides directional light, in direction from a plane of an inner surface of the lighting element towards the rear side;

wherein an inner surface of the lighting element shelf is angled in a cross-sectional plane, such that the cross-sectional inner surface is not parallel with the cross-sectional window opening;

such that light emitted from the lighting element, will reflect at least one time on the reflector, before exiting the light fixture via the window opening.

* * * * *